US005295353A

United States Patent [19]

Ikari

[11] Patent Number: 5,295,353

[45] Date of Patent: Mar. 22, 1994

[54] CONTROLLING ARRANGEMENT FOR TRAVELLING WORK VEHICLE

[75] Inventor: Masanori Ikari, Kawagoe, Japan

[73] Assignees: Kabushiki Kaisha Komatsu Seisakusho; Komatsu MEC Kabushiki Kaisha, both of Tokyo, Japan

[21] Appl. No.: 941,440

[22] PCT Filed: Jun. 5, 1991

[86] PCT No.: PCT/JP91/00760

§ 371 Date: Oct. 23, 1992

§ 102(e) Date: Oct. 23, 1992

[87] PCT Pub. No.: WO91/19100

PCT Pub. Date: Dec. 12, 1991

[30] Foreign Application Priority Data

Jun. 6, 1990 [JP] Japan ..... 2-146167

[51] Int. Cl.[5] ..... F16D 31/02

[52] U.S. Cl. ..... 60/431; 60/468; 91/518; 417/34

[58] Field of Search ..... 60/431, 420, 422, 426, 60/428, 429, 430, 468, 452; 91/511, 518; 417/34

[56] References Cited

U.S. PATENT DOCUMENTS

| | | | |
|---|---|---|---|
| 4,002,220 | 1/1977 | Wible | 60/422 X |
| 4,679,396 | 7/1987 | Heggie | 60/431 X |
| 4,790,135 | 12/1988 | Noji | 60/452 X |
| 4,856,278 | 8/1989 | Widmann et al. | 60/452 X |
| 4,864,994 | 9/1989 | Myers | 60/431 X |
| 4,942,737 | 7/1990 | Tatsumi | 60/431 |
| 5,077,974 | 1/1992 | Kamikawa et al. | 60/468 X |

FOREIGN PATENT DOCUMENTS

| | | |
|---|---|---|
| 5129301 | 8/1949 | Japan . |
| 5713889 | 6/1955 | Japan . |
| 50-16521 | 6/1975 | Japan . |
| 57-32089 | 2/1982 | Japan . |
| 57-12886 | 3/1982 | Japan . |

*Primary Examiner*—Edward K. Look
*Assistant Examiner*—Hoang Nguyen
*Attorney, Agent, or Firm*—Flynn, Thiel, Boutell & Tanis

[57] ABSTRACT

A device for controlling a vehicle for loading work and equipped with a plurality of hydraulic pumps of fixed capacity for loading work and a torque converter driven from an engine, an electronic control governor for optionally selecting output characteristic in steps for controlling output of the engine, changeover valves disposed in the circuit on the downstream side of one pump for changing over the flow of pressure oil to a drain circuit in response to working oil pressure or an electric signal, a selection switch for selecting the output characteristics, a governor controller for controlling engine the output characteristic as selected by the switch, and control circuits for actuating the changeover valves in response to the position of the selection switch.

5 Claims, 18 Drawing Sheets (M2 MODE)

(M2 MODE)

(M3 MODE)

(M3 MODE)

(M1 MODE)

(M1 MODE)

(M2 MODE)

(M2 MODE)

(M3 MODE)

(M3 MODE)

(M1 MODE)

(M1 MODE)

CONTROLLING ARRANGEMENT FOR TRAVELLING WORK VEHICLE

TECHNICAL FIELD

The present invention relates to a device and a method for controlling a construction vehicle mainly for loading work such as a wheel loader, etc.

BACKGROUND OF THE INVENTION

A conventional control system of a device for controlling a wheel loader mainly for loading work is illustrated in FIG. 11.

With reference to FIG. 11, the output of an engine E is transmitted to a torque converter TC and a gear G and the output transmitted to the gear G drives hydraulic pumps $P_1$ and $P_2$ of a fixed capacity.

A bucket operation pilot valve AL is operated to actuate a bucket main operation valve AV to thereby turn a bucket A by way of a bucket cylinder AC, so that the bucket A tilts rearward or dumps forward.

A boom operation pilot valve BL is operated to actuate a boom main operation valve BV to thereby turn a boom B by way of a boom cylinder BC, so that the boom B lifts upward or lowers downward.

Designated at PP is a pilot pump.

The performance of the hydraulic pumps P1 and P2 of a fixed capacity in the conventional control system of a working machine is illustrated in FIG. 12(*a*).

In the same figure, $P_1$, $P_2$, $Q_1$ and $Q_2$ represent respectively the oil pressures and the flow rates of the hydraulic pumps P1 and P2.

A rectangle surrounded by O-$P_2$-$P_2Q_2$ point-$Q_2$ is a region where the hydraulic pump $P_2$ alone operates and a hatching portion surrounded by O-$P_2$-$P_2Q_2$ point-$P_1Q_2$ point-$P_1Q_1$ point-$Q_1$ is a region where both the hydraulic pumps $P_1$ and $P_2$ operate.

FIG. 12(*b*) is a graph showing a torque curve of the output of an engine wherein $T_{EM}$ is a torque curve at the full throttling time, $T_{EM\,G}$ is a torque curve when an electronic control type governor operates, $T_T$ is an absorption torque curve of a torque converter, $N_{C1}$ is an engine speed at the point where the absorption torque curve $T_T$ intersects the torque curve $T_{EM\,G}$, $T_{PA}$ is an average hydraulic pump torque when the oil pressure in a hydraulic circuit of a working machine is low, $T_{A1}$ is a torque at the point where the absorption torque curve $T_T$ intersects the curve of the torque obtained by subtracting $T_{PA}$ from $T_{EM}$, $T_{B1}$ is a torque at the point where the absorption torque curve $T_T$ intersects the curve of the torque obtained by subtracting $T_{PB}$ from $T_{EM}$, and $N_{B1}$ is an engine speed at that time.

Referring back to FIG. 12(*a*), designated at $P_A$ is a pressure at the point where the average hydraulic pump torque curve $T_{PA}$ at a low oil pressure intersects the vertical line connecting the $P_1Q_1$ point to $Q_1$ and $P_B$ is an oil pressure at the point where the average oil pressure pump torque curve $T_{PB}$ at a high oil pressure intersects the vertical line connecting the $P_2Q_2$ point to $Q_2$.

As is evident from FIGS. 12(*a*) and (*b*), according to the conventional control system of the working machine, the distribution of the output of the engine to the travel of the vehicle and the operation of the working machine are selected in two steps depending on the oil pressure, namely, a high pressure or a low pressure in the hydraulic circuit of the working machine.

That is, the hydraulic pump torque $T_{PB}$, i.e. an oil pressure load $T_{PB}$ is reduced at the high pressure (e.g. at the excavating time) so that the torque curve $T_{EM}$, i.e. the output $T_{EM}$ of the engine is much distributed to the travel torque $T_{B1}$ and the hydraulic pump torque $T_{PA}$, i.e. an oil pressure load $T_{PA}$ is increased at the low pressure (e.g. at the load lifting time) so that the output $T_{EM}$ of the engine is much distributed to the operation of the working machine, whereby the output of the engine can be effectively utilized.

In the conventional control system, since the engine torque $T_{EM}$ is fixed, the distribution of the torque at the travelling time and the working time is limited by the pump capacity ($Q_1$ or $Q_1+Q_2$) so that the output of the engine for the travel is difficult to be ideally set (actually an operator performs the throttle operation to thereby control the travel output).

There is such a serious problem in the conventional control system for selecting the pump capacity in two steps by the oil pressure alone that the variation of the output of the working machine, particularly the variation of the speed of the working machine occurs in the middle of working so that an unskilled operator can hardly operate the working machine.

There is another problem that the engine speed hardly increases when it is changed from a low speed to a speed burst and a heavy load working is required adding to that.

It is an object of the present invention to solve the problems set forth above.

SUMMARY OF THE INVENTION

To achieve the above object, the present invention provides a device for controlling a loading work vehicle equipped with a plurality of hydraulic pumps of a fixed capacity for a loading work machine and with a torque converter, the device comprising an engine equipped with an electronic control type governor or an electric governor as a means for controlling the output of the engine, changeover valves for changing over the flow of pressure oil to a drain circuit in response to the oil pressure of the working machine or an electric instruction are disposed in the circuit on the downstream side of one of the hydraulic pumps for the working machine, a selection switch for selecting output characteristics, a governor controller for controlling engine output characteristic selected by said switch, and a cut-off valve controller for actuating the changeover valves in response to the electric instruction of the selection switch.

Furthermore, the device is equipped with means for detecting stepping amount of an accelerator pedal and an engine speed detector, both of which give instruction signals to the governor controller, and a selection switch for changing over from a forward second speed to a forward first speed wherein the governor controller decides a full throttled state at a low engine speed and the changeover from the forward second speed to the forward first speed, thereby issuing a switchover valve signal to the switchover valve to reduce an oil pressure load of the engine. Still furthermore, a maximum engine speed of the engine equipped with the electric governor controller is varied in response to an output signal of a working oil pressure detector of the working machine.

DETAILED DESCRIPTION

An embodiment of the present invention will be described with reference to drawings.

Figure 1:
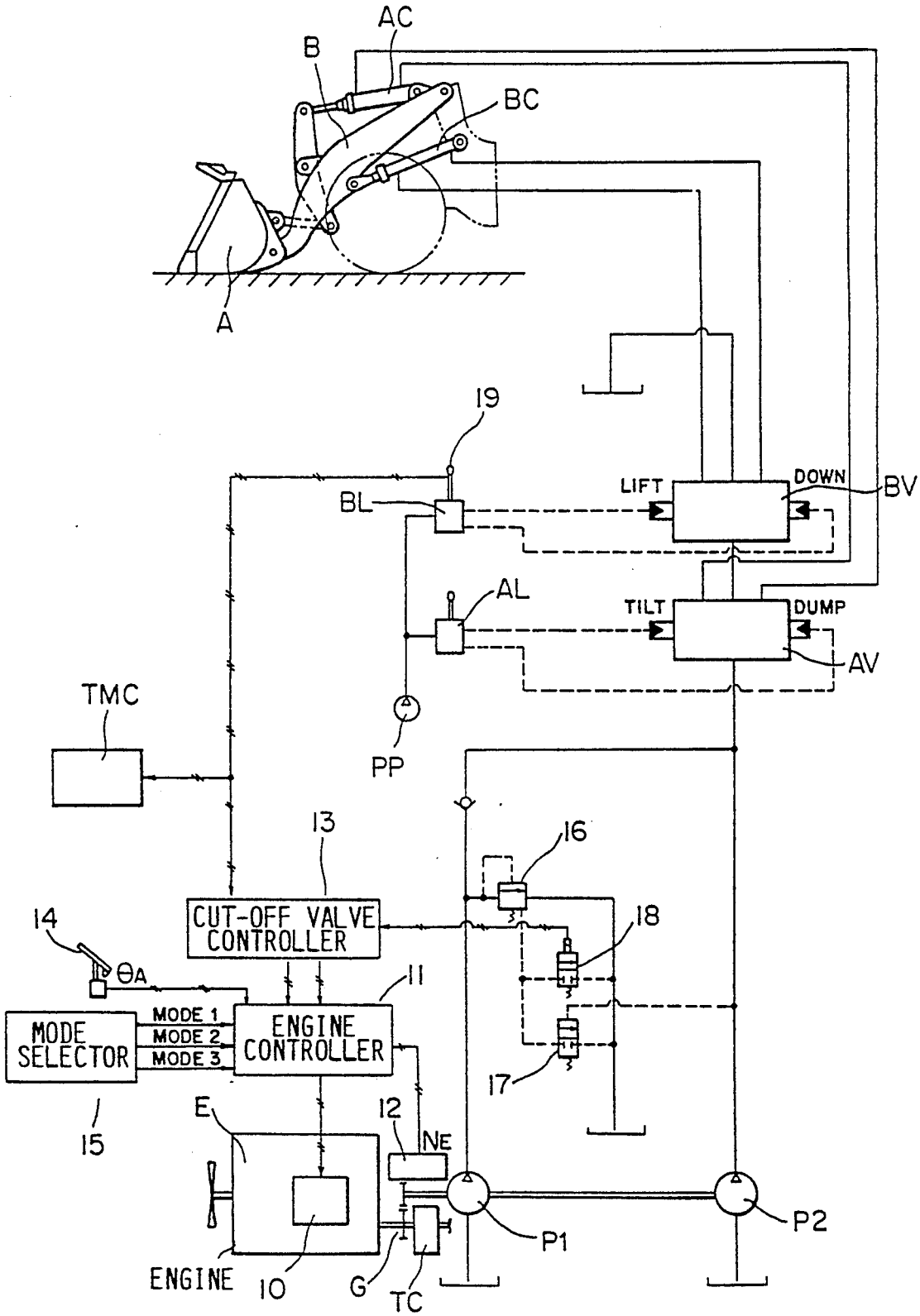
FIG. 1 is a view showing the control system of a vehicle for loading work according to a first embodiment of the present invention, FIG. 2(*a*) is a graph showing pump torque characteristic curves at an M2 mode, FIG. 2(*b*) is a graph showing power distribution characteristic curves at the M2 mode.
Figure 11:
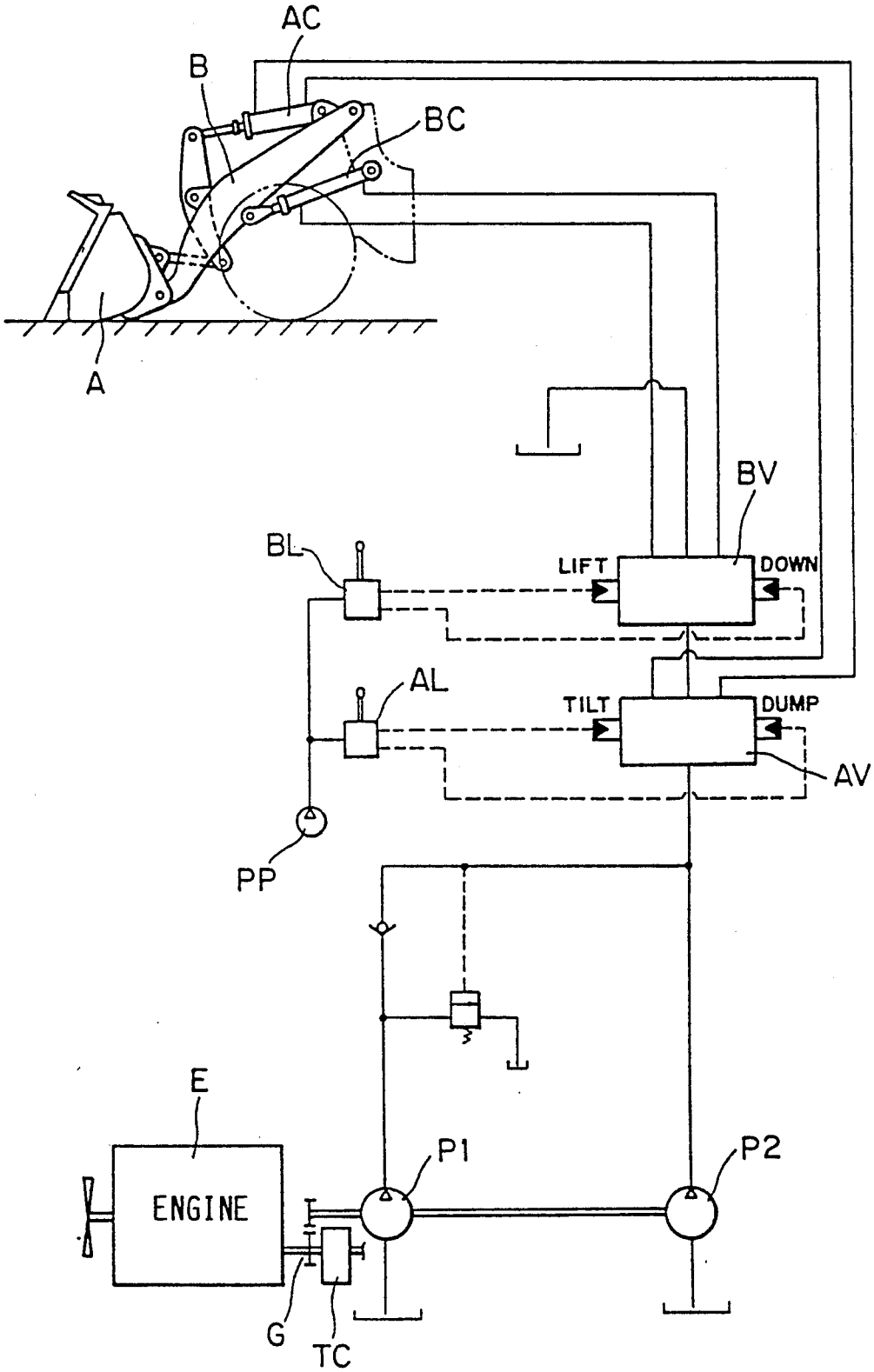
FIG. 11 (PRIOR ART)
FIG. 11 shows a conventional control system diagram and FIGS. 12(*a*) and (*b*) are graphs showing pump torque characteristic curves and power distribution characteristic curves at the M1 mode according to the first embodiment of the present invention (and the conventional one in FIG. 11).

FIG. 1 is a view showing the control system of a vehicle for loading work according to the first embodiment of present invention wherein elements which operate in the same way as the conventional system as explained in FIG. 11 are denoted at the same numerals.

An engine E has an electronic control type governor 10 which is mounted thereon and is capable of optionally selecting output characteristics in steps and an electronic governor controller 11 is provided for controlling the electronic control type governor 10 in response to input signals (1) to (4) set forth hereunder.

(1) a signal representing an engine speed $N_E$ issued by a rotary sensor 12 provided on the gear G (2) a cut-off valve operation signal issued by a cut-off valve controller 13 (the electronic governor controller 11 receives the cut-off valve signal as the input signal and issues information signals)

(3) a stepping amount signal $\sigma_A$ issued by an accelerator pedal 14

(4) mode signals issued by a mode selection switch 15

The cut-off valve controller 13 receives signals from and sends signals to the electronic governor controller 11 and receives signals issued by an F2 (forward second speed)-F1(forward first speed) selection switch 19 provided at a boom operation pilot valve BL (TMC is a transmission controller) and outputs a signal to a changeover valve, i.e. an electromagnetic pilot cut-off valve 18 to thereby select the electromagnetic pilot cut-off valve 18. A changeover valve, i.e. a pilot unload valve 17, which is selectively switched by the oil pressure of the hydraulic pump P2, is provided at the discharge side of the hydraulic pump P2. Since the pilot unload valve 17 and the electromagnetic pilot cut-off valve 18 are respectively coupled to the pilot oil pressure side of a main unload valve 16, the unload oil pressure of the hydraulic pump P1 is determined by the oil pressure of the hydraulic pump P2 and the cut-off valve controller 13.

An operation of the embodiment will be described hereinafter.

Figure 12A:
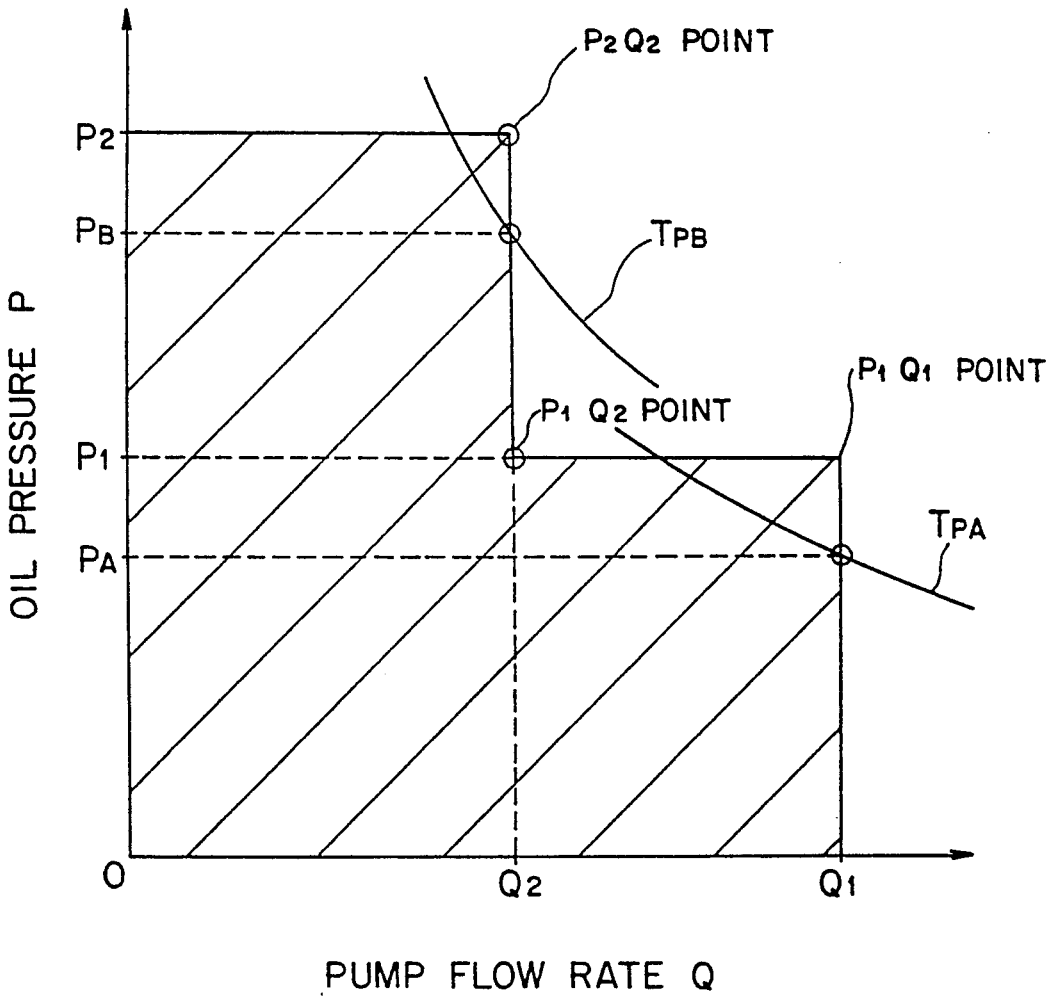
Figure 12B:
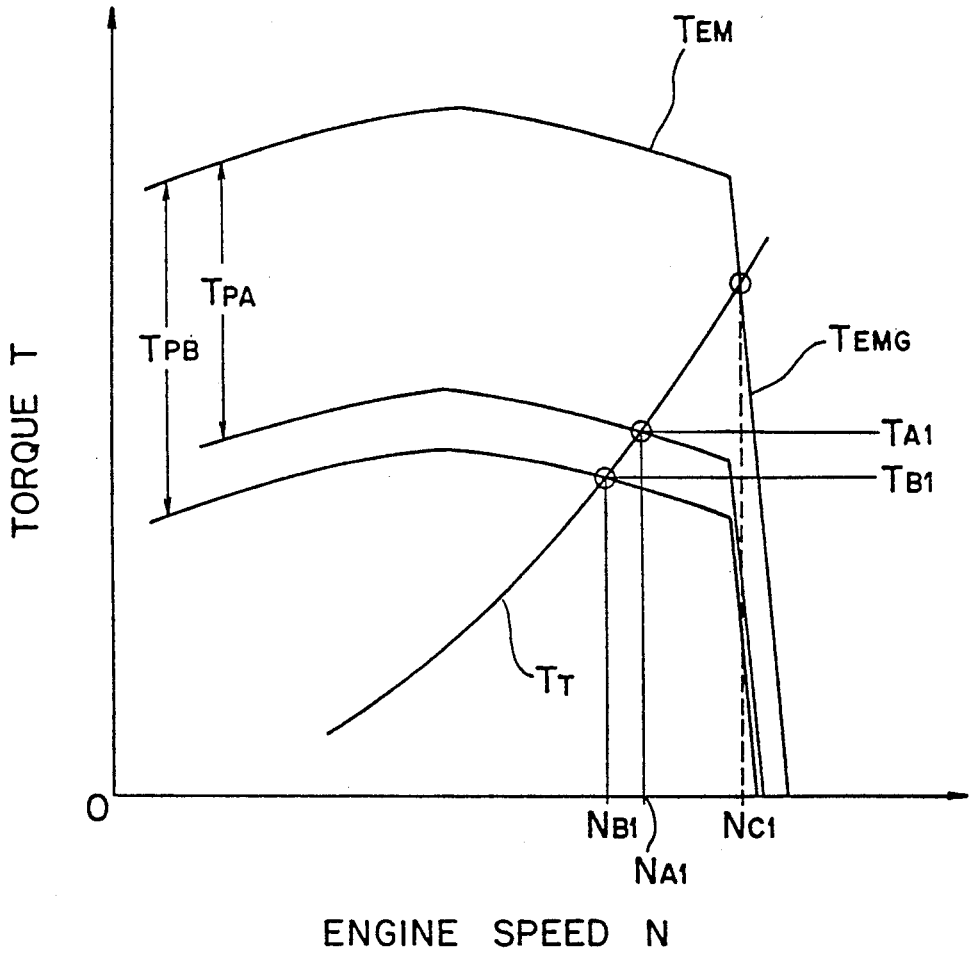

If the mode 1 is selected by operating the selection switch 15, the M1 mode is obtained in the same way as the conventional method which is explained in FIGS. 12(*a*) and (*b*).

Figure 2A:
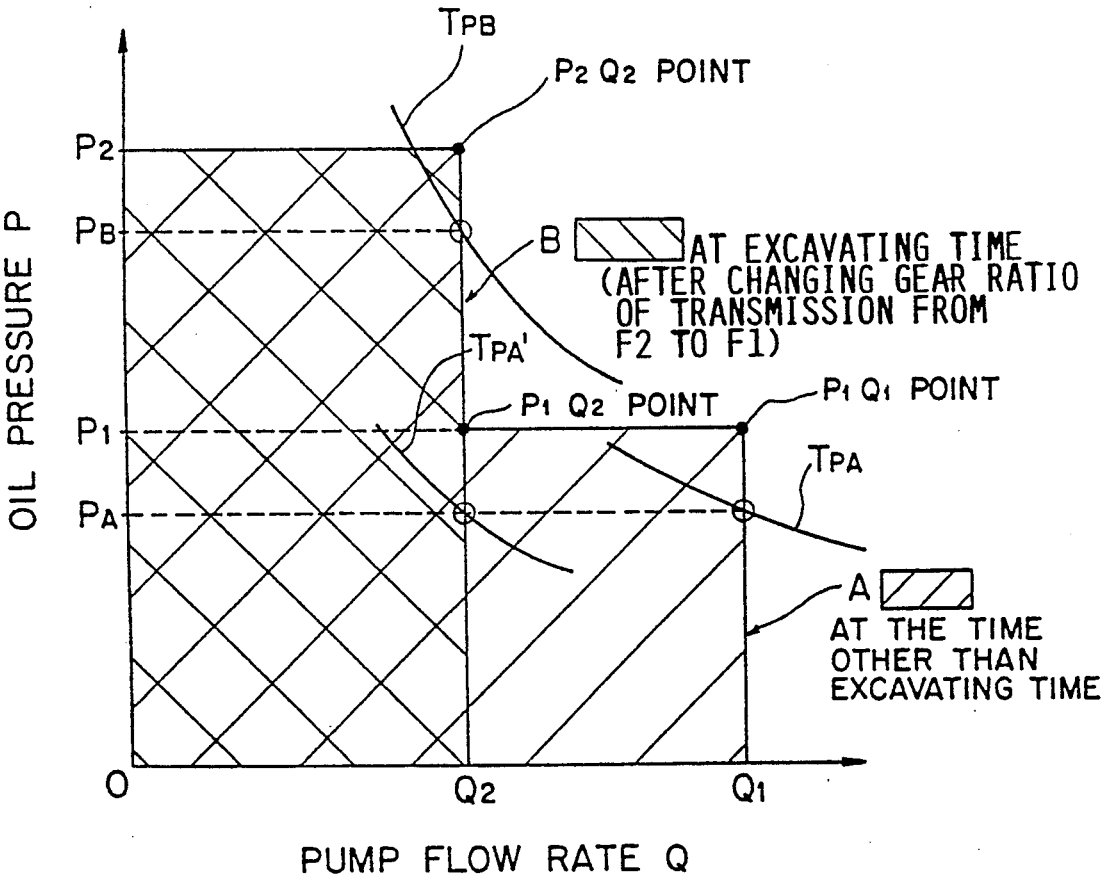
Figure 2B:
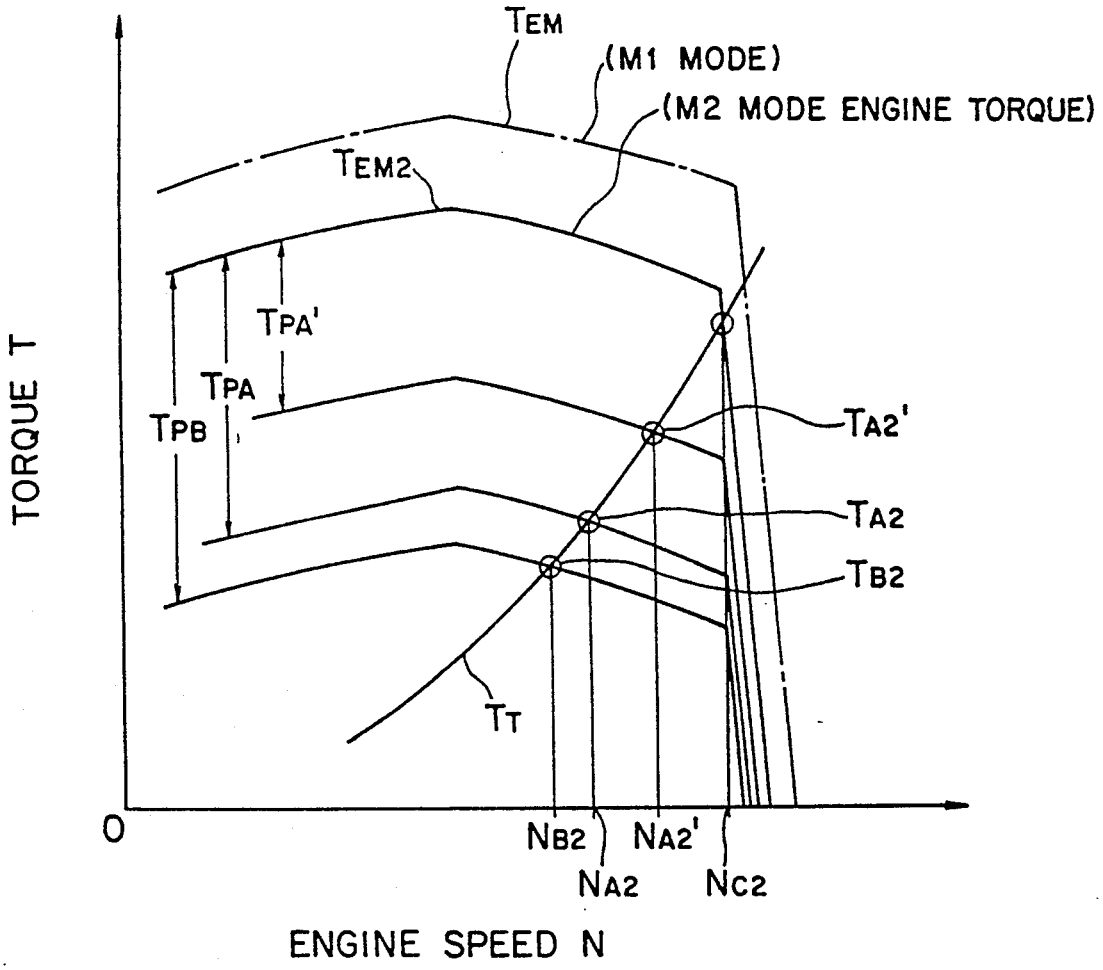

If the mode 2 is selected, the electromagnetic cut-off valve 18 is positioned at a cut-off position at the excavating time alone so that the M2 mode is obtained as illustrated in FIGS. 2(*a*) and (*b*).

That is, in FIGS. 2(*a*) and (*b*), those which are denoted at the same numerals as those in FIGS. 12(*a*) and (*b*) are same. At the M2 mode, an engine torque as denoted at $T_{EM2}$ is set under the output $T_{EM}$ of the engine as illustrated in FIG. 2(*b*).

Since the average oil pressure pump torque $T_{PA}$ and the average oil pressure pump torque $T_{PB}$ are respectively taken from the engine torque $T_{EM2}$, the available travel engine torque curves intersect the absorption torque curve $T_T$ at the points of $T_{A2}$ and $T_{B2}$ (each corresponding to the driving power and the travel speed of the vehicle) so that the available travel engine torques are represented by line segments $T_{A2}N_{A2}$ and $T_{B2}N_{B2}$.

Although high oil pressure is required at the excavating time when the transmission gear ratio is changed from the forward second speed F2 to the forward first speed F1, the hydraulic pump P2 alone is operated since the excavating operation is easily made at the time when the amount of oil is less varied.

The oil pressure versus the flow rate of the hydraulic pump is shown in FIG. 2(*a*) as the region (denoted at B) surrounded by O-$P_2$-$P_2Q_2$ point-$Q_2$.

Since the electromagnetic pilot cut-off valve 18 is positioned at the cut-off position, the average oil pressure pump torque $T_{PA}'$ at the low pressure at this time is under the average oil pressure pump torque $T_{PA}$ as illustrated in FIG. 2(*a*) and the engine torque corresponding to the driving power and travel speed of the vehicle at this time is represented by line segment $T_{A2}'$-$N_{A2}'$ which is larger than line segment $T_{A2}N_{A2}$ as illustrated in FIG. 2(*b*) so that the performance of the vehicle is improved.

That is, if the M1 mode is compared with the M2 mode, the following expressions are established, wherein the driving power at the M2 mode is set to be equal to or less than that at the M1 mode.

$$T_{A2} < T_{A1}, \quad N_{A2} < N_{A1}$$
$$T_{B2} < T_{B1}, \quad N_{B2} < N_{B1}$$
$$T_{A2}' \approx T_{A1}, \quad N_{A2}' \approx N_{A1}$$

An operation procedure at the M2 mode is illustrated in the flow chart of FIG. 3 which reads as follows.

(1) (Start)→(2) (M2 mode?)→(3) (F2 to F1 selection switch is ON?)→(4){Cut-off valve output is ON (Pump P1 unload).}

Figure 4A:
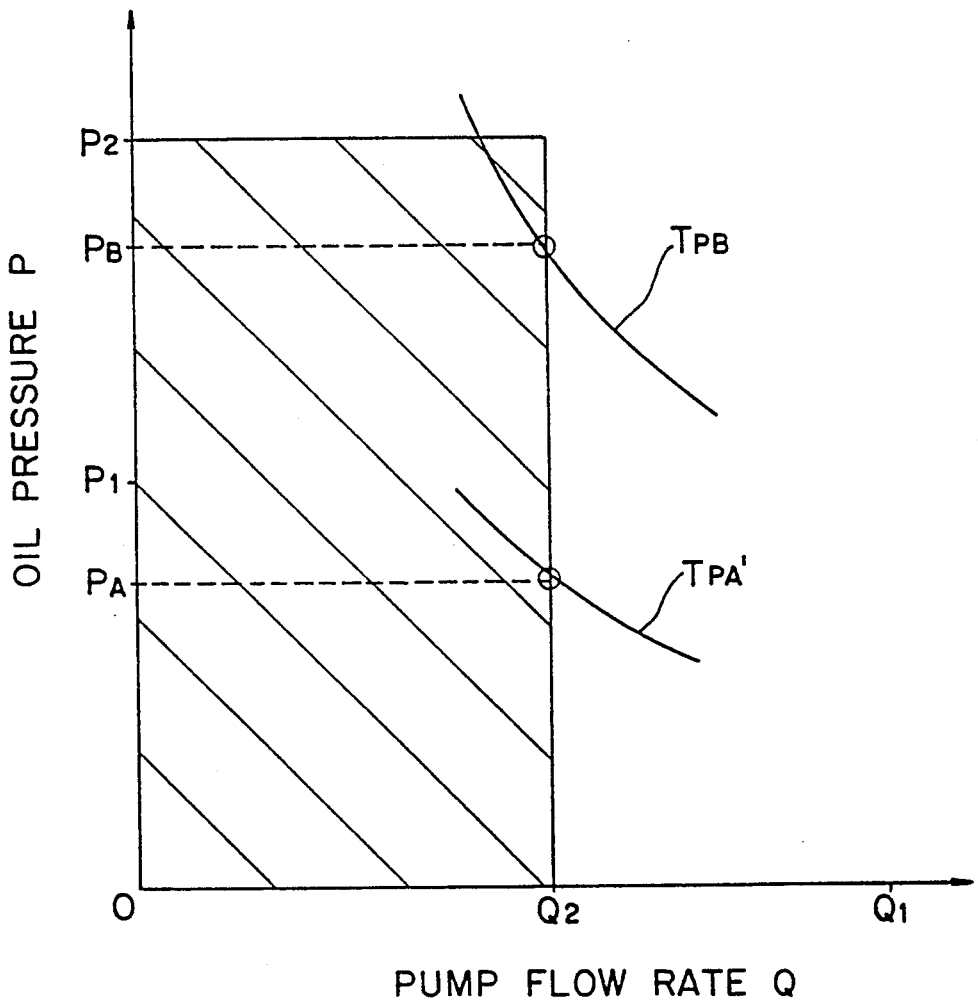
Figure 4B:
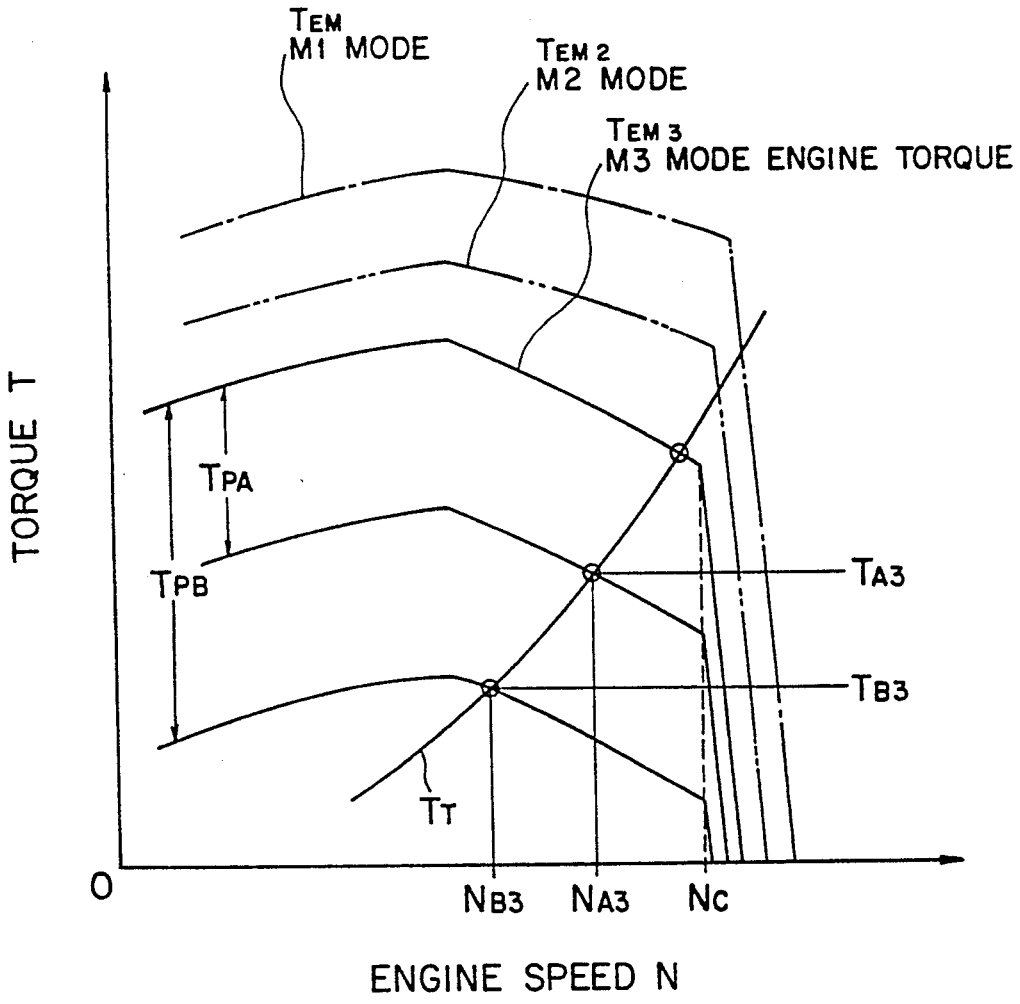

If the selection switch 15 is operated to select the M3 mode, the electromagnetic pilot cut-off valve 18 is always positioned at the cut-off position so that the M3 mode as illustrated in FIGS. 4(*a*) and (*b*) is obtained.

That is, since the device is usually operated by the hydraulic pump P2 alone, when the M2 mode is compared with the M3 mode, the following expressions are established wherein the driving power at the M3 mode is equal to or less than that at the M2 mode.

$$T_{A3} \approx T_{A2}, \quad N_{A3} \approx N_{A2}$$
$$T_{B3} < T_{B2}, \quad N_{B3} < N_{B2}$$

An operation procedure at the M3 mode is illustrated in the flow chart of FIG. 3 which reads as follows.

(1) (Start)→(2) (M2 mode?)→(5) (M3 mode?)→(4) {Cut-off valve output is ON (Pump P1 unload).

Figure 5:
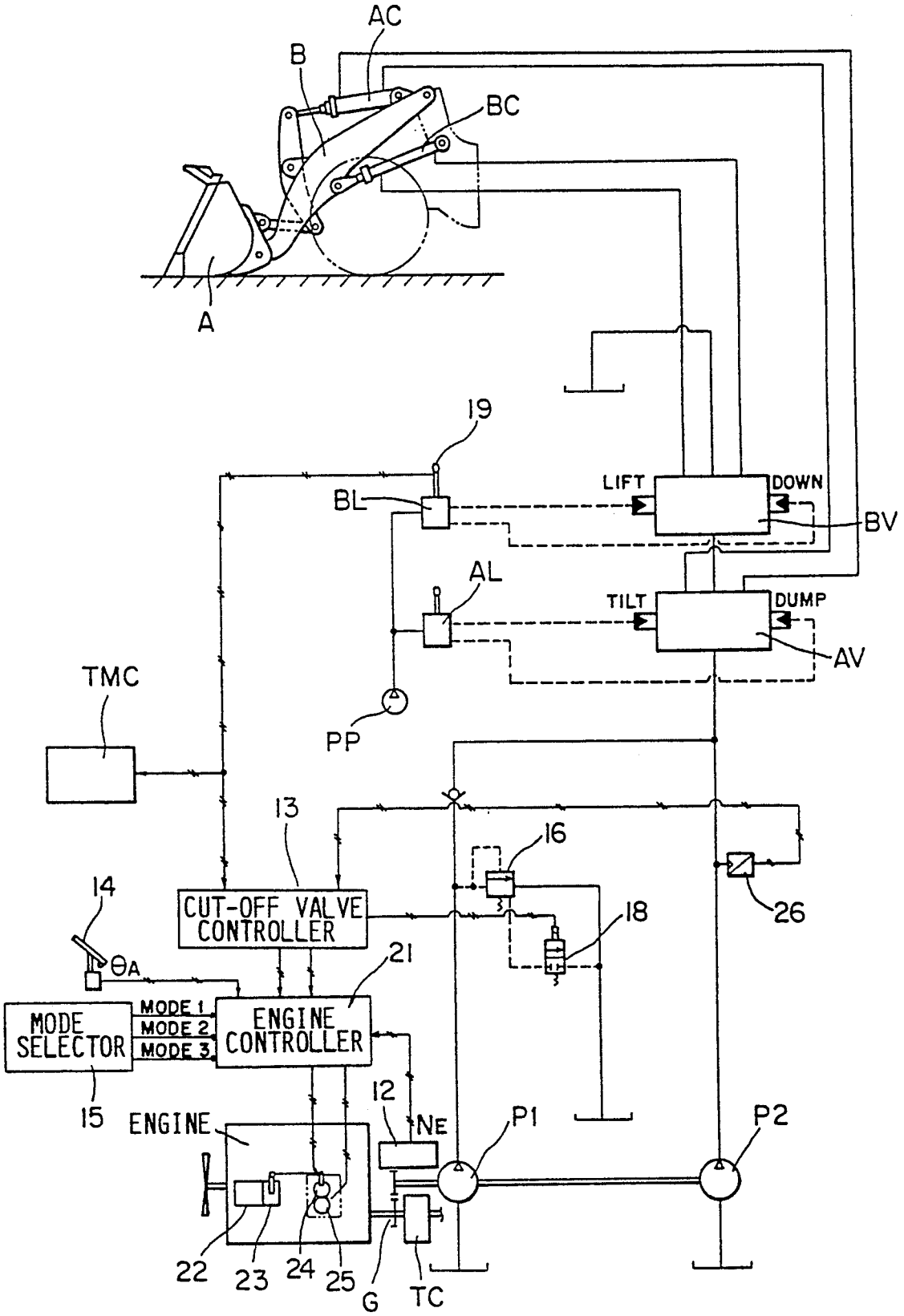
FIG. 5 is a control system diagram according to a second embodiment of the present invention and FIGS. 6(*a*) and (*b*), FIGS. 7(*a*) and (*b*), and FIGS. 8(*a*) and (*b*) are graphs showing pump torque characteristic curves and power distribution characteristic curves at an M1 mode, the M2 mode and the M3 mode.

FIG. 5 is a view showing a control system according to a second embodiment of the present invention wherein the difference between the second embodiment and the first embodiment is that the electronic control type governor 10 in FIG. 1 is replaced by an electric governor 23 in FIG. 5 which successively can turn the control lever of the governor and the electronic governor controller 11 in FIG. 1 is replaced by an electric governor controller 21 in FIG. 5 and furthermore the pilot unload valve 17 in FIG. 1 is omitted but a pressure detector (analog) 26 is provided.

Designated at 22 is an injection pump, 23 is the electric governor, 24 is a governor motor and 25 is a governor potentiometer.

Figure 6A:
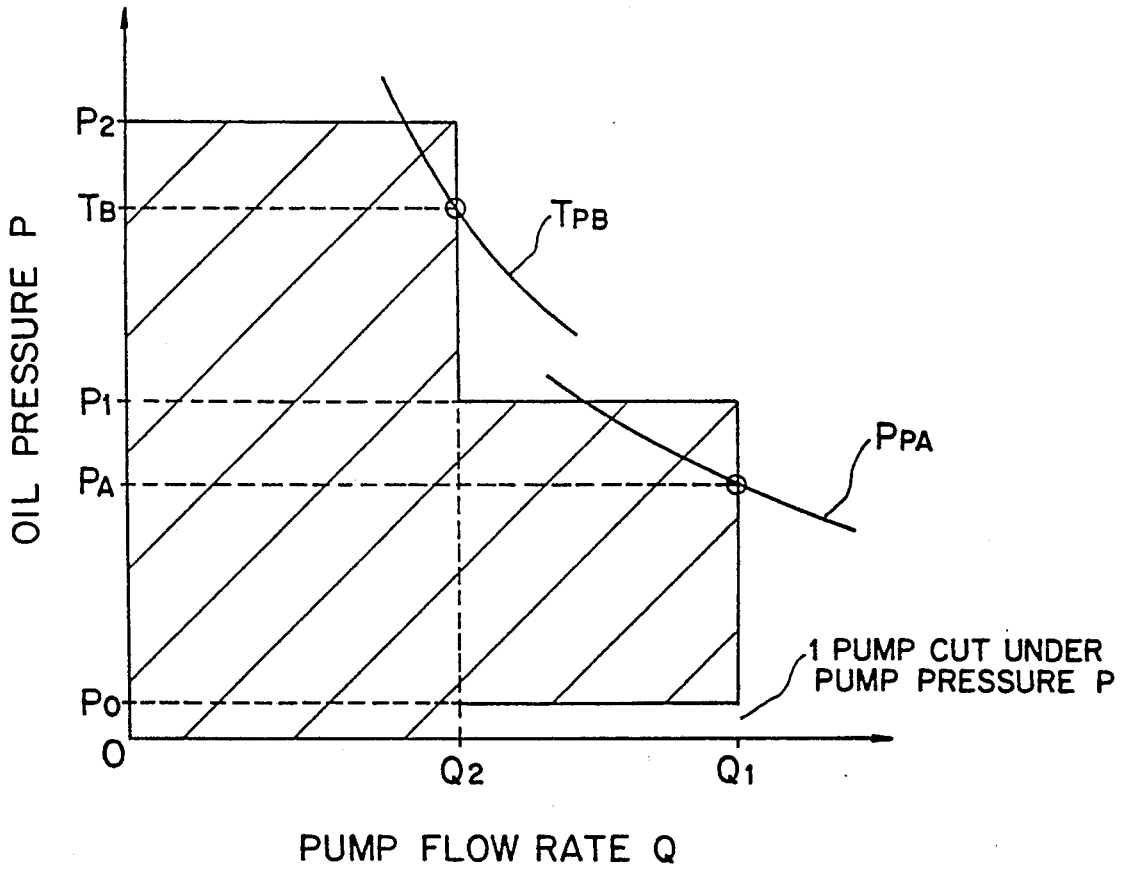
Figure 6B:
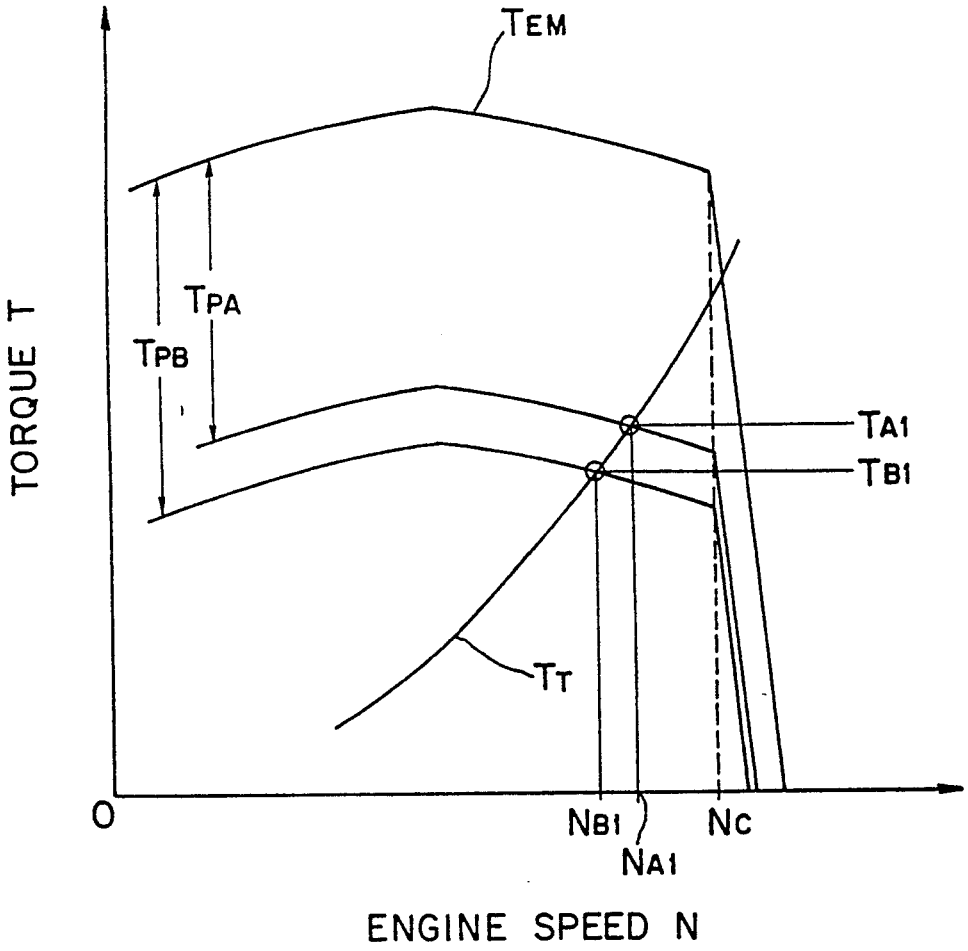
Figure 7A:
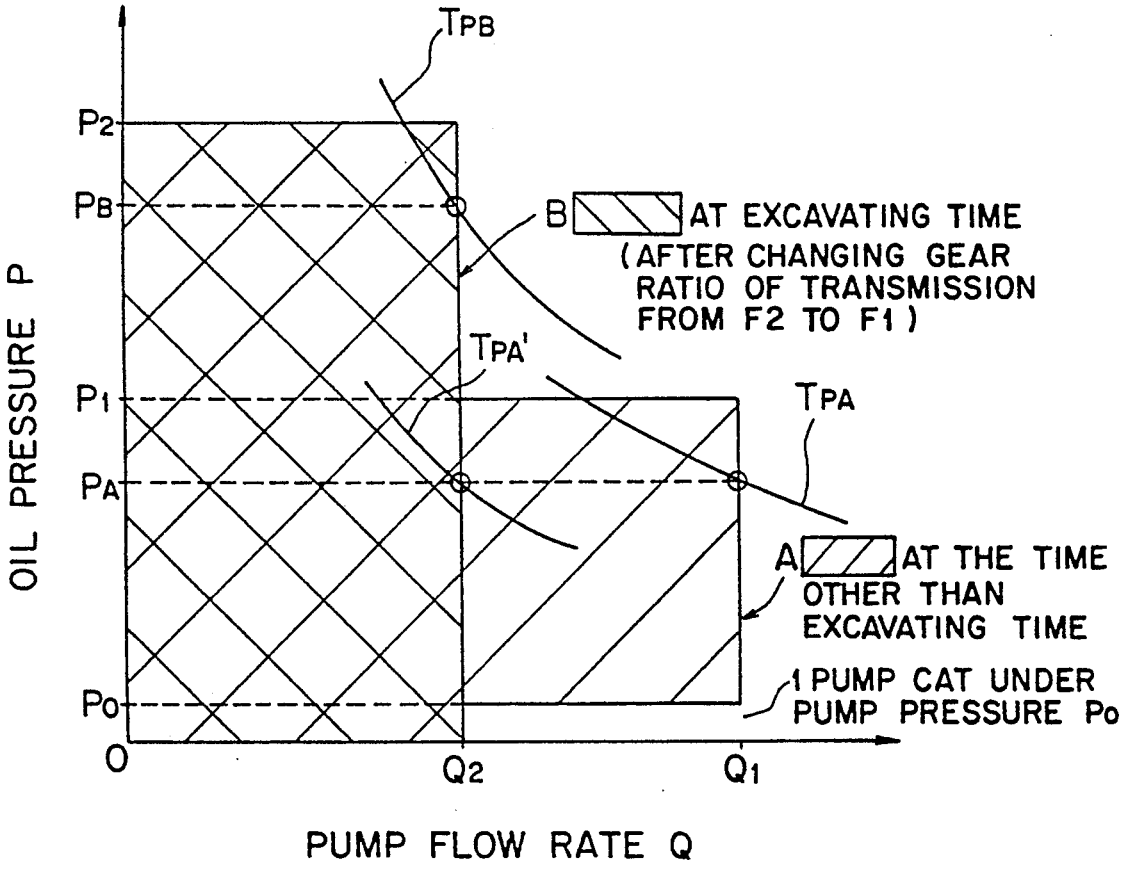
Figure 7B:
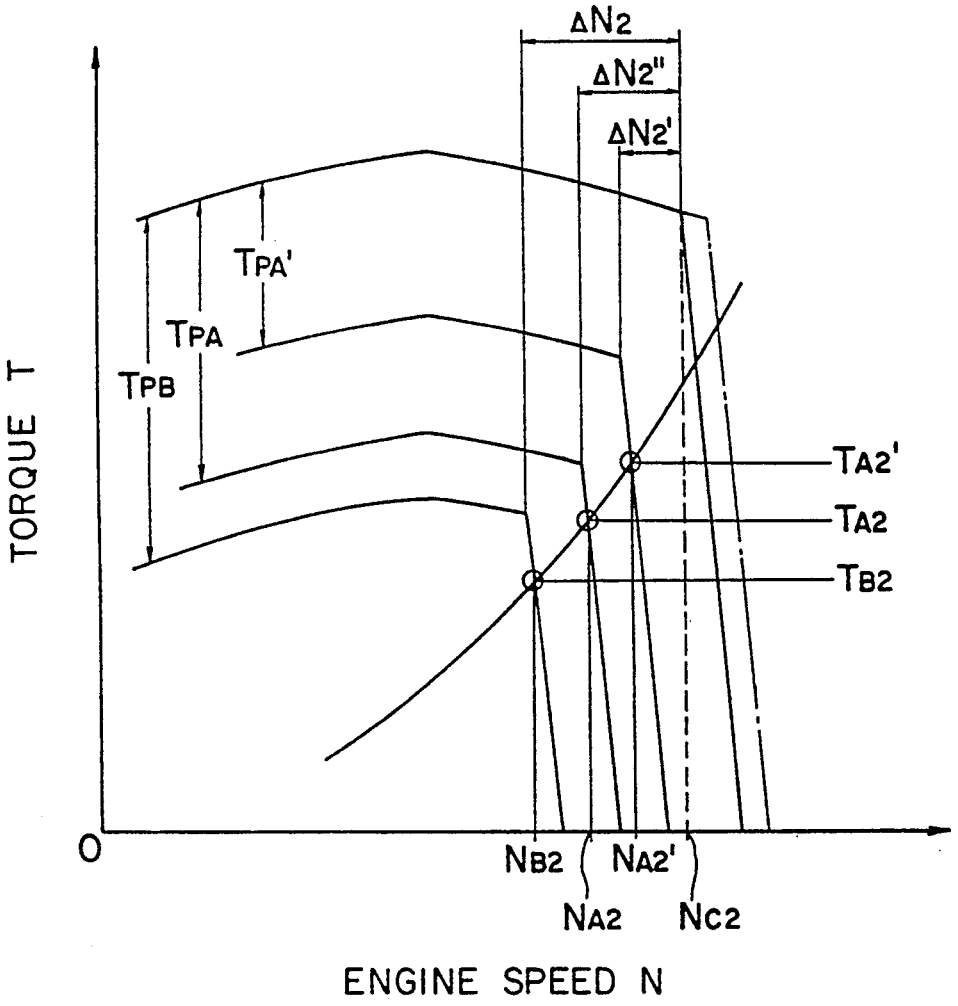
Figure 8A:
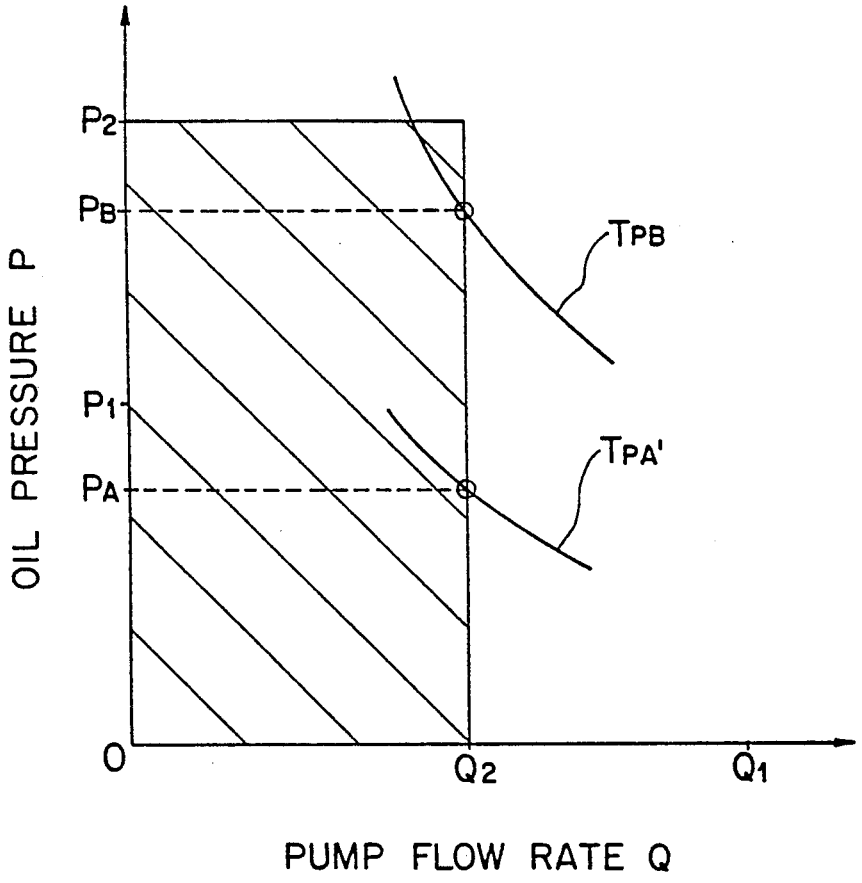
Figure 8B:
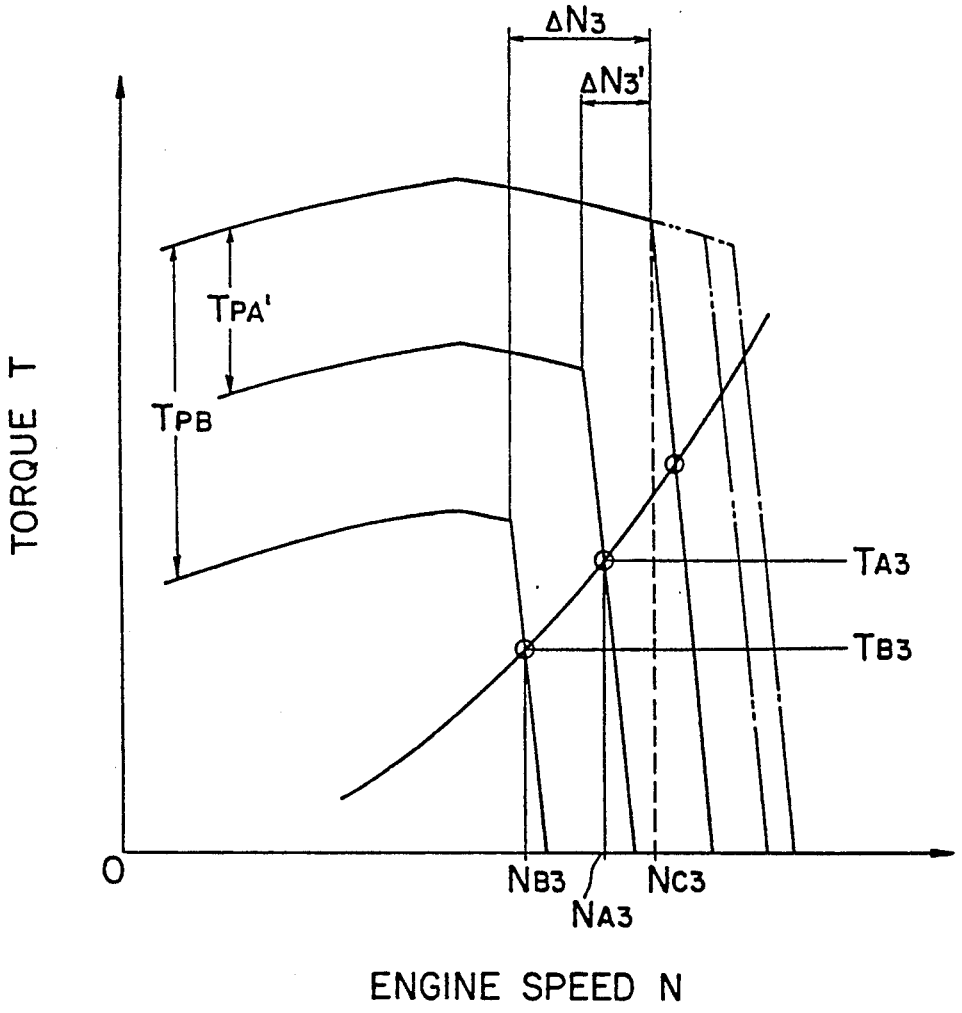

Performance curves according to the second embodiment is illustrated in FIGS. 6(*a*) and (*b*) (M1 mode), FIGS. 7(*a*) and (*b*) (M2 mode) and FIGS. 8(*a*) and (*b*) (M3 mode) which are substantially respectively similar to the performance curves according to the first embodiment as illustrated in FIGS. 12(*a*) and (*b*) (M1 mode), FIGS. 2(*a*) and (*b*) (M2 mode) and FIGS. 4(*a*) and (*b*) (M3 mode). Set forth hereunder is only the difference between the performance curves of the first embodiment and those of the second embodiment.

The maximum engine speed which is controlled by the electric governor controller 21 varies in response to the amplitude of the output signal issued by the pressure detector 26 as illustrated in FIG. 7(*b*) and FIG. 8(*b*).

That is, the maximum engine speed is restricted by the oil pressure load (the engine torque $T_{EM}$ is fixed) and the reduction ratio $\Delta N$ of the maximum engine speed is proportional to the oil pressure P and is set to meet the following expression so as to set the optimum driving power against the oil pressure load. That is, at the M2 mode, in case that the forward second speed F2 is changed to the forward first speed F1, the expression of $\Delta N_2'/N_2 \approx P_A/P_B$ is established while in other cases, the expression of $\Delta N_2''/\Delta N_2' = K$ (proportional constant) is established and at the M3 mode, the expression of $\Delta N_3'/N_3 \approx P_A/P_B$ is established.

Figure 9:
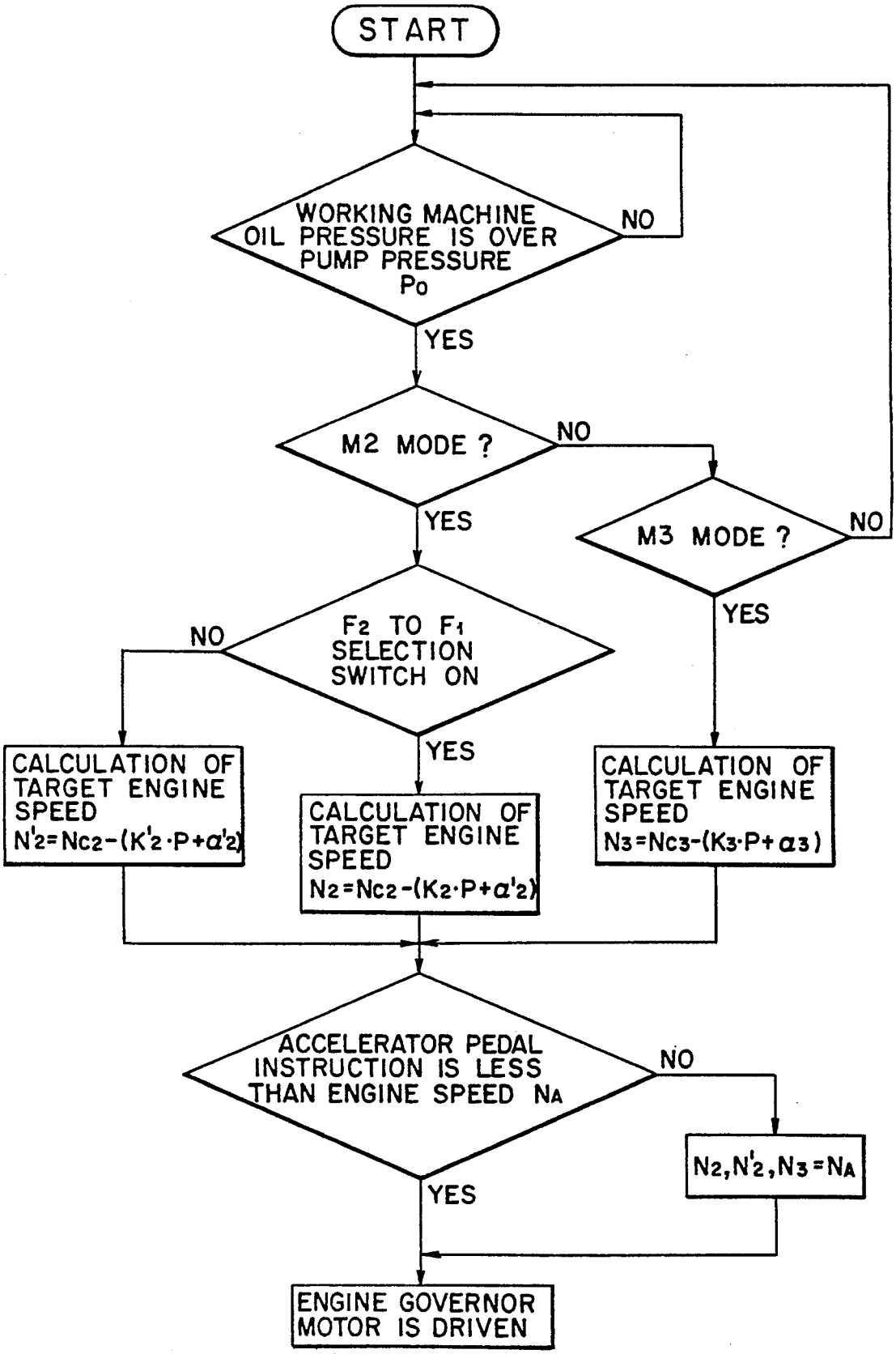
FIG. 9 is a flow chart showing an operating procedure according to the second embodiment of the present invention.

A control flow chart at this time is illustrated in FIG. 9.

Described hereinafter are a method of and an operation of controlling the cut-off valve by the engine speed and the stepping amount of the accelerator pedal.

The control method is common to the first embodiment as illustrated in FIG. 1 and the second embodiment as illustrated in FIG. 5 wherein the accelerator pedals are represented respectively as electric pedals 14 and cut-off valves are represented as electromagnetic pilot cut-off valve 18.

Figure 3:
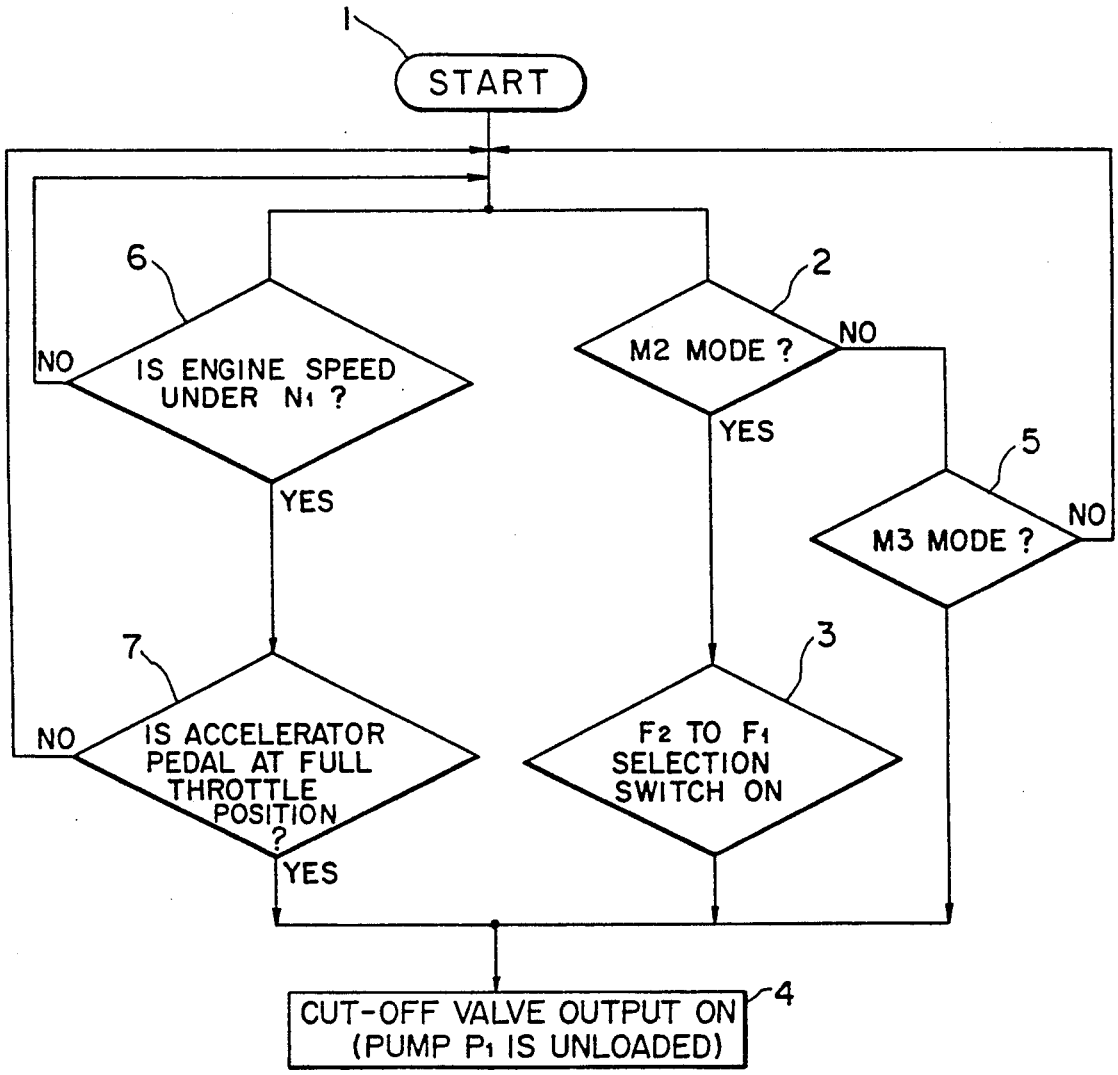
FIG. 3 is a flow chart showing an operating procedure, FIG. 4(*a*) is a graph showing pump torque characteristic curves at an M3 mode of FIG. 4(*b*) is a graph showing a power distribution characteristic curve at the M3 mode.
Figure 10:
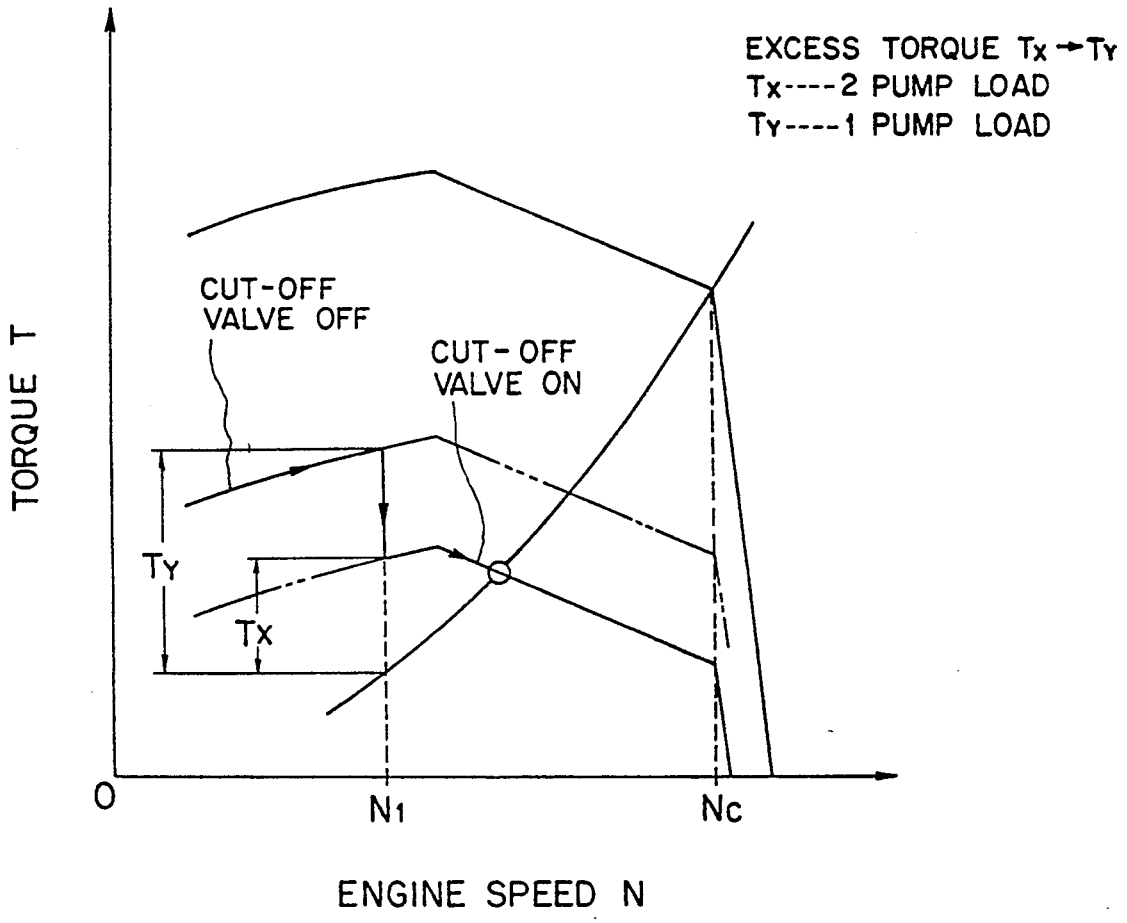
FIG. 10 is a view showing a method of controlling the cut-off valve by the engine speed and the stepping amount of the accelerator pedal.

According to the control flow chart in FIG. 3, an operation procedure reads as (1) (Start)→(6) {Less than engine speed $N_1$(a previously set engine speed)?}→(7) (Is accelerator pedal at a full throttle position?)→(4) {Cut-off valve output is ON (Pump P1 is unloaded).} (Also refer to FIG. 10).

Accordingly, for example, when the engine speed is low and an excess torque of the engine is low such as the time when the vehicle accelerates while lifting the load, an oil pressure consumption torque is temporarily reduced to thereby improve the increase of the engine speed.

With the arrangement as set forth above in detail, the present invention has the following great effect.

(1) Since engine output, hydraulic driving power, and driving power can be set in a plurality of degrees by combining the cut-off conditions of the hydraulic pumps in steps in response to the selected engine output, functions of the vehicle can be set according to the work load or work amount.

Since the oil pressure load is electrically selected at the M2 and M3 modes, the working speed in response to the nature of the work can be obtained and even an unskilled operator can operate the device with ease.

Since the engine output, the hydraulic driving power, and the driving power are respectively restricted by the work load at the M2 and M3 modes, the fuel consumption can be reduced.

(2) It is possible to set functions of the vehicle according to the work load since the distribution of the hydraulic driving power and the driving power can be optionally set relative to the output of the engine by permitting the governor lever to turn automatically.

Since the output of the engine is restricted according to the work load, the fuel consumption can be reduced.

Furthermore, since the governor control is automatically made, it is not necessary for the operator to operate frequently the throttle valve (stepping operation).

(3) If there occurs such a need that the engine speed is changed from the low speed to the speed burst and the heavy load is required, e.g. at the time of starting the engine while lifting the load, it is possible to improve the accelerating performance of the engine.

(4) It is possible to work with ease without enlarging variation of the working speed at the excavating time by varying the pump load and operating only one of the hydraulic pumps when the operator operates the F2 (forward second speed)-F1(forward first speed) selection switch 19 to issue the instruction at the excavating time at the M2 mode. Furthermore, it is possible to restrict the oil pressure torque at the excavating time.

I claim:

1. A control system for a vehicle having an engine which simultaneously supplies power to a drive system and a hydraulic working system via an output shaft, said control system comprising:

an electronic governor coupled to said engine for selectively controlling output characteristics thereof;

a governor controller coupled to said governor for controlling the governor in accordance with a plurality of input signals;

first and second fixed capacity hydraulic pumps mechanically coupled to said output shaft for supplying pressurized hydraulic oil to said hydraulic working system;

a torque converter for mechanically coupling said output shaft to said drive system;

a user operable selection switch means cooperating with said controller for manually selecting first, second and third operational modes which respectively represent desired engine output characteristics;

a pilot-type pressure relief valve means serially coupled between a discharge side of said first pump and a sump;

a first changeover valve means coupled to a pilot line of said pressure relief valve means for permitting said pressure relief valve means to communicate said discharge side of said first pump with said sump when said pressurized hydraulic oil at a discharge side of said second pump exceeds a predetermined value;

a second changeover valve means coupled to said pilot line of said pressure relief valve means for permitting said pressure relief valve means to communicate said discharge side of said first pump with said sump when said second changeover valve means is activated;

speed selection switch means defining first and second speed positions;

controlling means responsive to signals received from said governor controller and said speed selection switch means for sending signals to and effecting activation of said second changeover valve means, said controlling means effecting activation of said second changeover valve means upon receiving a signal from the governor controller that the selection switch means is in said third mode, and said controlling means sending a signal to said second changeover valve means to cause activation thereof upon receiving both a signal from said governor controller that the selection switch means is in said second mode and a signal from the speed selection switch means that the latter is in a selected said speed position.

2. In a travelling working vehicle having a working apparatus including a movable boom controlled by first pressure cylinder means and a working element movably supported on the boom and controlled by a second pressure cylinder means, the first and second pressure cylinder means being respectively controlled by first and second valve means, the vehicle having an engine and a torque converter coupled to the output of the engine for controlling travelling of the vehicle, and first and second hydraulic fixed-capacity pumps driven by the output of the engine at the same time as the torque converter, said pumps supplying pressure fluid to the first and second valve means;

unload valve means operated by a pilot pressure fluid for causing, when activated, the pressure fluid discharged from solely said first pump to be returned to a sump;

controller means for controlling the operational characteristics of the engine, and mode selector means coupled to the controller means for permitting selection of first, second and third operating modes;

first control valve means for controlling pilot pressure to said unload valve means, said first control valve means being responsive to and activated by a pilot pressure from said second pump for causing activation of said unload valve means only when said first control valve means is activated by a predetermined pressure from said second pump, said unload valve means being activated solely by said first control valve means when said mode selector means is in said first mode;

second control valve means for controlling pilot pressure to said unload valve means for permitting activation of said unload valve means when said second control valve means is activated;

valve control means for receiving signals from said controller means and for activating said second control valve means when said mode selector is in said third mode;

speed selection switch means for defining first and second speed positions and for transmitting a signal to said valve controller means only when in one of said first and second speed condition; and said valve control means activating said second control valve means to activate said unload valve means when said mode selector means is in said second mode and upon receipt of said signal from said speed selection switch means.

3. In a tavelling work vehicle having a swingable boom and a working element movably mounted on the boom, first pressure cylinder means coupled to the boom for controlling movement thereof, second pressure cylinder means coupled to the working element for controlling movement thereof relative to the boom, an engine having an output, a torque converter coupled to the output of the engine for effecting travelling of the vehicle, first and second fixed capacity hydraulic pumps driven from the output of the engine, and a control arrangement for controlling the supply of pressure fluid from the pumps to the first and second pressure cylinder means, said control arrangement including first and second valve means for respectively controlling flow of pressure fluid to the first and second cylinder means, comprising the improvement wherein said control arrangement includes:

unloading valve means coupled to the output of said first pump for permitting, when activated, flow of pressure fluid from said first pump back to a sump;

changeover valve means coupled to pilot pressure of said unloading valve means for controlling activation of said unload valve means;

governor controller means for controlling output of said engine;

mode selecting means for permitting selection of first, second and third operating modes and for inputting the selected mode to the governor controller means, said first mode permitting both of said first and second pumps to be operational for supplying pressure fluid to said first and second valve means, said second mode permitting said first pump to be coupled to the sump when in a first forward speed condition, and said third mode causing said first pump to be continually coupled to sump;

forward speed switch means operable between first and second forward speed positions and for outputting a signal when moved from the second forward condition to the first forward speed condition;

valve control means for sending signals to and receiving signals from said governor controller means and for controlling activation of said changeover valve means, said valve controller means causing activation of said changeover valve means so as to in turn cause activation of said unloading valve means when said valve controller means receives said signal from said forward speed switch means and said mode selection means is in said second operating mode, and said valve control means causing activation of said changeover valve means to activate said unloading valve means whenever said mode selection means is in said third operating mode.

4. A vehicle according to claim 3, including second changeover valve means coupled to the pilot pressure of the unloading valve means for causing activation of said unloading valve means whenever said second changeover valve means is activated, said second changeover valve means being activated in response to the pressure from said second pump reaching a predetermined value.

5. A vehicle according to claim 3, wherein said forward speed selection means is provided at a pilot valve which controls operation of said first valve means.

* * * * *